US010060685B2

(12) United States Patent
Matsui et al.

(10) Patent No.: US 10,060,685 B2
(45) Date of Patent: Aug. 28, 2018

(54) LAMINATED HEADER, HEAT EXCHANGER, AND AIR-CONDITIONING APPARATUS

(71) Applicant: Mitsubishi Electric Corporation, Tokyo (JP)

(72) Inventors: Shigeyoshi Matsui, Tokyo (JP); Shinya Higashiiue, Tokyo (JP); Takehiro Hayashi, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/510,265

(22) PCT Filed: Nov. 4, 2014

(86) PCT No.: PCT/JP2014/079185
§ 371 (c)(1),
(2) Date: Mar. 10, 2017

(87) PCT Pub. No.: WO2016/071946
PCT Pub. Date: May 12, 2016

(65) Prior Publication Data

US 2017/0328652 A1 Nov. 16, 2017

(51) Int. Cl.
*F28F 9/02* (2006.01)
*F28F 1/02* (2006.01)
(Continued)

(52) U.S. Cl.
CPC ..... *F28F 9/0268* (2013.01); *F28D 1/05333* (2013.01); *F28F 1/022* (2013.01);
(Continued)

(58) Field of Classification Search
CPC ..... F28F 9/0268; F28F 1/022; F28F 9/0275; F28F 13/08; F28F 3/086; F28D 1/05333;
(Continued)

(56) References Cited

U.S. PATENT DOCUMENTS 4,537,217 A 8/1985 Allen, Jr.
5,241,839 A 9/1993 Hughes
(Continued)

FOREIGN PATENT DOCUMENTS

CN 203798026 U 8/2014
JP H06-011291 A 1/1994
(Continued)

OTHER PUBLICATIONS

International Search Report of the International Searching Authority dated Jan. 27, 2015 for the corresponding International application No. PCT/JP2014/079185 (and English translation).
(Continued)

*Primary Examiner* — Davis Hwu
(74) *Attorney, Agent, or Firm* — Posz Law Group, PLC

(57) ABSTRACT

A laminated header includes: a plurality of plate-like members laminated with each other; one first opening; a plurality of second openings; and a distribution flow passage connecting the one first opening and each of the plurality of second openings to each other. The distribution flow passage includes: a first passage having a straight line shape; a first branching flow passage for the first passage to branch into a plurality of passages; a second passage that has a straight line shape and is connected to each of the plurality of passages branched in the first branching flow passage; a second branching flow passage for the second passage to branch into a plurality of passages; and a third passage that has a straight line shape and is connected to each of the plurality of passages branched in the second branching flow passage.

9 Claims, 6 Drawing Sheets

(51) Int. Cl.

| | |
|---|---|
| ***F28F 13/08*** | (2006.01) |
| ***F28D 1/053*** | (2006.01) |
| *F25B 41/04* | (2006.01) |
| *F28F 3/08* | (2006.01) |
| *F25B 39/02* | (2006.01) |

(52) U.S. Cl.
CPC ..... *F28F 9/0275* (2013.01); *F28F 13/08* (2013.01); *F25B 39/028* (2013.01); *F25B 41/046* (2013.01); *F28F 3/086* (2013.01)

(58) Field of Classification Search
CPC .... F28D 1/0478; F28D 1/0426; F28D 9/0062; F25B 39/028; F25B 41/046; F25B 39/02
USPC ..... 165/173
See application file for complete search history.

(56) References Cited

U.S. PATENT DOCUMENTS

| | | | | |
|---|---|---|---|---|
| 5,242,016 | A | 9/1993 | Voss et al. | |
| 6,494,253 | B2 * | 12/2002 | Gotou | F28D 9/0062 165/115 |
| 6,892,805 | B1 | 5/2005 | Valensa | |
| 7,367,203 | B2 * | 5/2008 | Katoh | F25B 39/02 62/515 |
| 8,726,976 | B2 * | 5/2014 | Schrader | F28D 1/0426 165/140 |
| 2005/0103486 | A1 * | 5/2005 | Demuth | F28D 1/0478 165/174 |
| 2013/0174924 | A1 | 7/2013 | Luo et al. | |
| 2016/0116231 | A1 | 4/2016 | Higashiiue et al. | |

FOREIGN PATENT DOCUMENTS

| | | | |
|---|---|---|---|
| JP | H09-189463 | A | 7/1997 |
| JP | H11-101530 | A | 4/1999 |
| JP | 2006-125652 | A | 5/2006 |
| JP | 2007-531861 | A | 11/2007 |
| JP | 2010-139085 | A | 6/2010 |
| JP | 2014-081149 | A | 5/2014 |
| WO | 2014/083651 | A1 | 6/2014 |
| WO | 2014/185391 | A1 | 11/2014 |

OTHER PUBLICATIONS

Office action dated Mar. 29, 2018 issued in corresponding Australian patent application No. 2014410872.
Extended European Search Report dated May 23, 2018 issued in corresponding European patent application No. 14 90 5368.8.
Office action dated Jun. 21, 2018 issued in corresponding CN patent application No. 201480082968.1 (and English ranslation thereof).

* cited by examiner

LAMINATED HEADER, HEAT EXCHANGER, AND AIR-CONDITIONING APPARATUS

CROSS REFERENCE TO RELATED APPLICATION

This application is a U.S. national stage application of PCT/JP2014/079185 filed on Nov. 4, 2014, the contents of which are incorporated herein by reference.

TECHNICAL FIELD

The present invention relates to a laminated header, a heat exchanger, and an air-conditioning apparatus.

BACKGROUND ART

A laminated header configured to distribute and supply refrigerant to each heat transfer tube of a heat exchanger has hitherto been known. In this laminated header, which is configured to distribute and supply refrigerant to each heat transfer tube of the heat exchanger, there are laminated a plurality of plate-like members having formed therein distribution flow passages that are branched into a plurality of outlet flow passages for one inlet flow passage (see, for example, Patent Literature 1).

CITATION LIST

Patent Literature

Patent Literature 1: Japanese Unexamined Patent Application Publication No. Hei 9-189463 (see, for example, FIG. 1)

SUMMARY OF INVENTION

Technical Problem

In such a laminated header, in order to ensure the performance of the heat exchanger that functions as an evaporator, keeping a ratio of flow rates of flows of liquid refrigerant that flows out of each of the plurality of outlet flow passages, that is, a distribution ratio uniform such that the refrigerant is uniformly supplied to each heat transfer tube of the heat exchanger is crucial.

In the related-art laminated header, liquid refrigerant concentrates hin the distribution flow passages as the refrigerant repeatedly branches in the branching flow passages, and the liquid refrigerant nonuniformly flows out of the plurality of outlets of the laminated header. Then, the refrigerant is nonuniformly supplied to each heat transfer tube of the heat exchanger, leading to a problem in that the heat exchange performance of the heat exchanger is reduced.

The present invention has been made in view of the above-mentioned problem, and has an object to obtain a compact laminated header configured to uniformly distribute refrigerant to each heat transfer tube of a heat exchanger, to thereby ensure the heat exchange performance of the heat exchanger. Further, the present invention has an object to provide the heat exchanger including the laminated header as described above. Still further, the present invention has an object to provide an air-conditioning apparatus including the heat exchanger as described above.

Solution to Problem

According to one embodiment of the present invention, there is provided a laminated header, including: a plurality of plate-like members, each of which being laminated with each other; one first opening; a plurality of second openings; and a distribution flow passage connecting the one first opening and each of the plurality of second openings to each other, the distribution flow passage including: a first passage having a straight line shape; a first branching flow passage for the first passage to branch into a plurality of passages; a second passage that has a straight line shape and is connected to each of the plurality of passages branched in the first branching flow passage; a second branching flow passage for the second passage to branch into a plurality of passages; and a third passage that has a straight line shape and is connected to each of the plurality of passages branched in the second branching flow passage, in which refrigerant flowing into the distribution flow passage flows through the first passage and the second passage in directions opposite to and reverse to each other, and flows through the second passage and the third passage in directions opposite to and reverse to each other.

Advantageous Effects of Invention

In the laminated header according to the present invention, refrigerant flowing into the distribution flow passage flows through the first passage and the second passage in directions opposite to and reverse to each other, and flows through the second passage and the third passage in directions opposite to and reverse to each other. Thus, the laminated header can be reduced in size, and the straight portion of the distribution flow passage can have a certain length. As a result, refrigerant can be prevented from concentrating, and a distribution ratio can be uniform over the branching flow passage.

DESCRIPTION OF EMBODIMENTS

Figure 1:
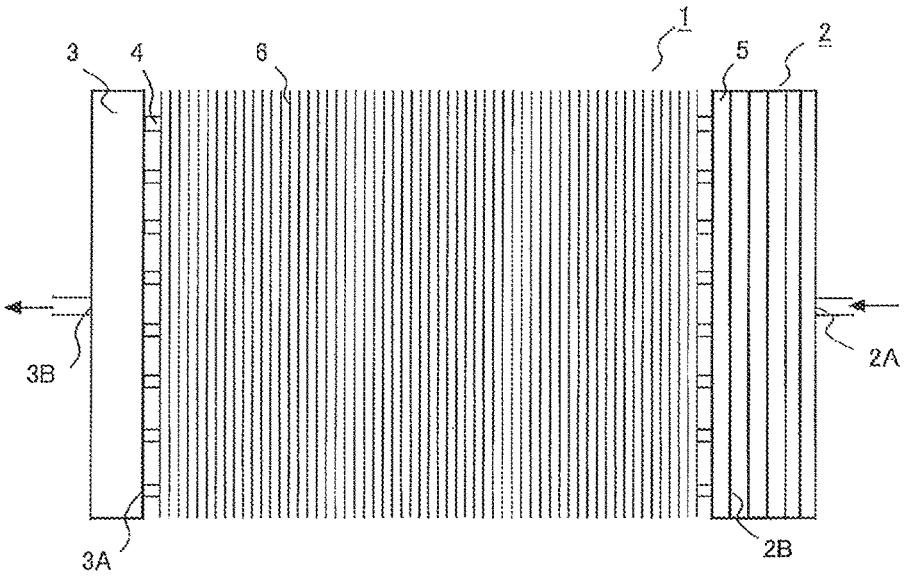
FIG. 1 is a view for illustrating a configuration of a heat exchanger according to Embodiment 1 of the present invention.

Now, a laminated header 2 according to the present invention is described with reference to the drawings.

In the following, there is described a case where the laminated header 2 according to the present invention distributes refrigerant flowing into a heat exchanger 1, but the laminated header 2 according to the present invention may distribute refrigerant flowing into other devices. Further, the configuration, operation, and other matters described below are merely examples, and the laminated header 2 according to the present invention is not limited to such configuration, operation, and other matters.

Further, in the drawings, the same or similar components are denoted by the same reference symbols, or the reference symbols therefor are omitted. Further, the illustration of details in the structure is appropriately simplified or omitted. Further, overlapping description or similar description is appropriately simplified or omitted.

Embodiment 1

The heat exchanger 1 according to Embodiment 1 of the present invention is described.

<Configuration of Heat Exchanger>

Now, the configuration of the heat exchanger 1 according to Embodiment 1 is described.

FIG. 1 is a view for illustrating the configuration of the heat exchanger according to Embodiment 1.

As illustrated in FIG. 1, the heat exchanger 1 includes the laminated header 2, a cylindrical header 3, a plurality of heat transfer tubes 4, a retaining member 5, and a plurality of fins 6.

The laminated header 2 includes one refrigerant inflow port 2A (corresponding to a first opening of the present invention) and a plurality of refrigerant outflow ports 2B (corresponding to a second opening of the present invention). The cylindrical header 3 includes a plurality of refrigerant inflow ports 3A and one refrigerant oufflow port 3B. Refrigerant pipes of a refrigeration cycle apparatus are connected to the refrigerant inflow port 2A of the laminated header 2 and the refrigerant outflow port 3B of the cylindrical header 3. The heat transfer tubes 4 are connected between the refrigerant outflow ports 2B of the laminated header 2 and the refrigerant inflow ports 3A of the cylindrical header 3.

The heat transfer tube 4 is a flat tube or a circular tube having a plurality of flow passages formed therein. The heat transfer tube 4 is made of, for example, copper or aluminum. End portions of the heat transfer tubes 4 on the laminated header 2 side are connected to the refrigerant outflow ports 2B of the laminated header 2 under a state in which the end portions are retained by the plate-like retaining member 5. The retaining member 5 is made of, for example, aluminum. The plurality of fins 6 are joined to the heat transfer tubes 4. The fin 6 is made of, for example, aluminum. In FIG. 1, there is illustrated a case where eight heat transfer tubes 4 are provided, but the present invention is not limited to such a case. For example, two heat transfer tubes 4 may be provided.

<Flow of Refrigerant in Heat Exchanger>

Now, the flow of the refrigerant in the heat exchanger 1 according to Embodiment 1 is described.

When the heat exchanger 1 functions as an evaporator, for example, the refrigerant flowing through the refrigerant pipe passes through the refrigerant inflow port 2A to flow into the laminated header 2 to be distributed, and then passes through the plurality of refrigerant oufflow ports 2B to flow out toward the plurality of heat transfer tubes 4. In the plurality of heat transfer tubes 4, the refrigerant is allowed to exchange heat with, for example, air supplied by a fan. The refrigerant flowing through the plurality of heat transfer tubes 4 passes through the plurality of refrigerant inflow ports 3A to flow into the cylindrical header 3 to be joined, and then passes through the refrigerant outflow port 3B to flow out toward the refrigerant pipe. When the heat exchanger 1 functions as a condenser, the refrigerant flows in a direction opposite to the direction described above.

<Configuration of Laminated Header>

Now, the configuration of the laminated header 2 of the heat exchanger 1 according to Embodiment 1 is described.

Figure 2:
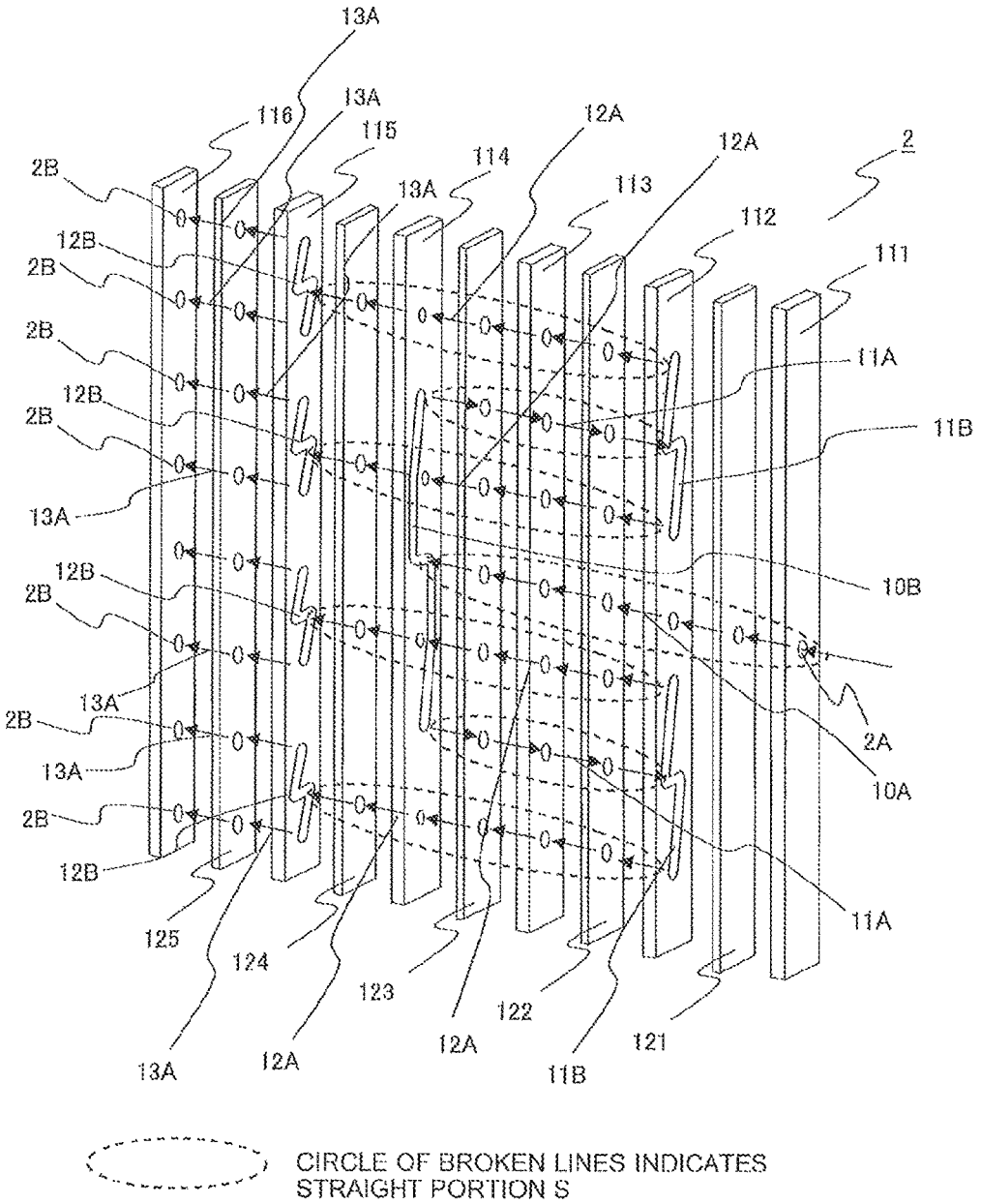
FIG. 2 is an exploded perspective view of a laminated header according to Embodiment 1.

FIG. 2 is an exploded perspective view of the laminated header 2 according to Embodiment 1.

The laminated header 2 illustrated in FIG. 2 includes, for example, first plate-like members 111, 112, 113, 114, 115, and 116 and second plate-like members 121, 122, 123, 124, and 125 sandwiched by the first plate-like members. The plate-like members each have, for example, a rectangular shape.

One or both surfaces of each of the second plate-like members 121, 122, 123, 124, and 125 are applied with a brazing material. The first plate-like members 111, 112, 113, 114, 115, and 116 are laminated via the second plate-like members 121, 122, 123, 124, and 125, and integrally joined together by brazing. The first plate-like members 111, 112, 113, 114, 115, and 116 and the second plate-like members 121, 122, 123, 124, and 125 each have a thickness of from about 1 mm to about 10 mm, and are made of aluminum, for example.

In the laminated header 2, distribution flow passages are formed by a first passage 10A, second passages 11A, third passages 12A, and fourth passages 13A that are circular through holes formed in the first plate-like members 111, 112, 113, 114, 115, and 116 and the second plate-like members 121, 122, 123, 124, and 125, and branching flow passages 10B, 11B, and 12B that are substantially Z-shaped through grooves. Each plate-like member is processed by pressing or cutting. When the plate-like member is processed by pressing, a plate having a thickness of 5 mm or less is used, which can be processed by pressing. When the plate-like member is processed by cutting, a plate having a thickness of 5 mm or more may be used.

The refrigerant pipe of the refrigeration cycle apparatus is connected to the first passage 10A of the first plate-like member 111. The first passage 10A of the first plate-like member 111 corresponds to the refrigerant inflow port 2A of FIG. 1.

The first passage 10A opens at substantially the centers of the first plate-like members 111, 112, and 113 and the second plate-like members 121, 122, and 123. Further, the pair of second passages 11A opens in the first plate-like member 113 and the second plate-like members 122 and 123 at positions opposed to each other across the first passage 10A.

In addition, the third passages 12A open in the first plate-like members 113 and 114 and the second plate-like members 122, 123, and 124 at four positions opposed to each other across the second passages 11A.

Further, the fourth passages 13A open in the first plate-like member 116 and the second plate-like member 125 at eight positions.

The first passage 10A, the second passages 11A, the third passages 12A, and the fourth passages 13A open at positions that are determined such that those passages communicate with the corresponding passages when the first plate-like members 111, 112, 113, 114, 115, and 116 and the second plate-like members 121, 122, 123, 124, and 125 are laminated.

Further, the first branching flow passage 10B is formed in the first plate-like member 114 (corresponding to first branching plate-like member of the present invention), the second branching flow passages 11B are formed in the first plate-like member 112 (corresponding to second branching plate-like member of the present invention), and the third branching flow passages 12B are formed in the first plate-like member 115.

Here, when the plate-like members are laminated to form the distribution flow passages, the first passage 10A is connected to the center of the first branching flow passage 10B formed in the first plate-like member 114, and the second passages 11A are connected to both the end portions of the first branching flow passage 10B.

Further, the second passages 11A are connected to the centers of the second branching flow passages 11B formed in the first plate-like member 112, and the third passages 12A are connected to both the end portions of each of the second branching flow passages 11B.

In addition, the third passages 12A are connected to the centers of the third branching flow passages 12B formed in the first plate-like member 115, and the fourth passages 13A are connected to both the end portions of each of the third branching flow passages 12B.

Accordingly, the distribution flow passages may be formed by laminating the first plate-like members 111, 112, 113, 114, 115, and 116 and the second plate-like members 121, 122, 123, 124, and 125 and joining the units together by brazing such that the passages are connected to the corresponding passages.

<Flow of Refrigerant in Laminated Header>

Next, the distribution flow passages and flow of refrigerant in the laminated header 2 are described.

When the heat exchanger 1 functions as the evaporator, two-phase gas-liquid refrigerant flows into the laminated header 2 through the first passage 10A of the first plate-like member 111. The flowed refrigerant travels straight in the first passage 10A, and collides with the surface of the second plate-like member 124 in the first branching flow passage 10B of the first plate-like member 114 to vertically branch in the gravity direction.

The branched refrigerant travels to each of both the end portions of the first branching flow passage 10B and flows into the pair of second passages 11A.

The refrigerant flowed into the second passages 11A travels straight in the second passages 11A in a direction opposite to and reverse to that of refrigerant traveling in the first passage 10A. The refrigerant collides with the surface of the second plate-like member 121 in the second branching flow passages 11B of the first plate-like member 112 to vertically branch in the gravity direction.

The branched refrigerant travels to each of both the end portions of the second branching flow passages 11B and flows into the four third passages 12A.

The refrigerant flowed into the third passages 12A travels straight in the third passages 12A in a direction opposite to and reverse to that of refrigerant traveling in the second passages 11A. The refrigerant collides with the surface of the second plate-like member 125 in the third branching flow passages 12B of the first plate-like member 115 to vertically branch in the gravity direction.

The branched refrigerant travels to each of both the end portions of the third branching flow passages 12B and flows into the eight fourth passages 13A.

The refrigerant flowed into the fourth passages 13A travels straight in the fourth passages 13A in a direction opposite to and reverse to that of refrigerant traveling in the second passages 11A. Then, the refrigerant flows out of the fourth passages 13A and flows into the plurality of heat transfer tubes 4 with uniform distribution through the passages of the retaining member 5.

In the distribution flow passages of Embodiment 1, the laminated header 2 in which refrigerant passes through the three branching flow passages and branches eight times is exemplified. However, the number of times of branching is not particularly limited.

<Regarding State of Liquid Film in Distribution Flow Passage in Laminated Header>

Now, a state of a liquid film in the passages in the laminated header 2 is described with reference to FIG. 3.

Figure 3:
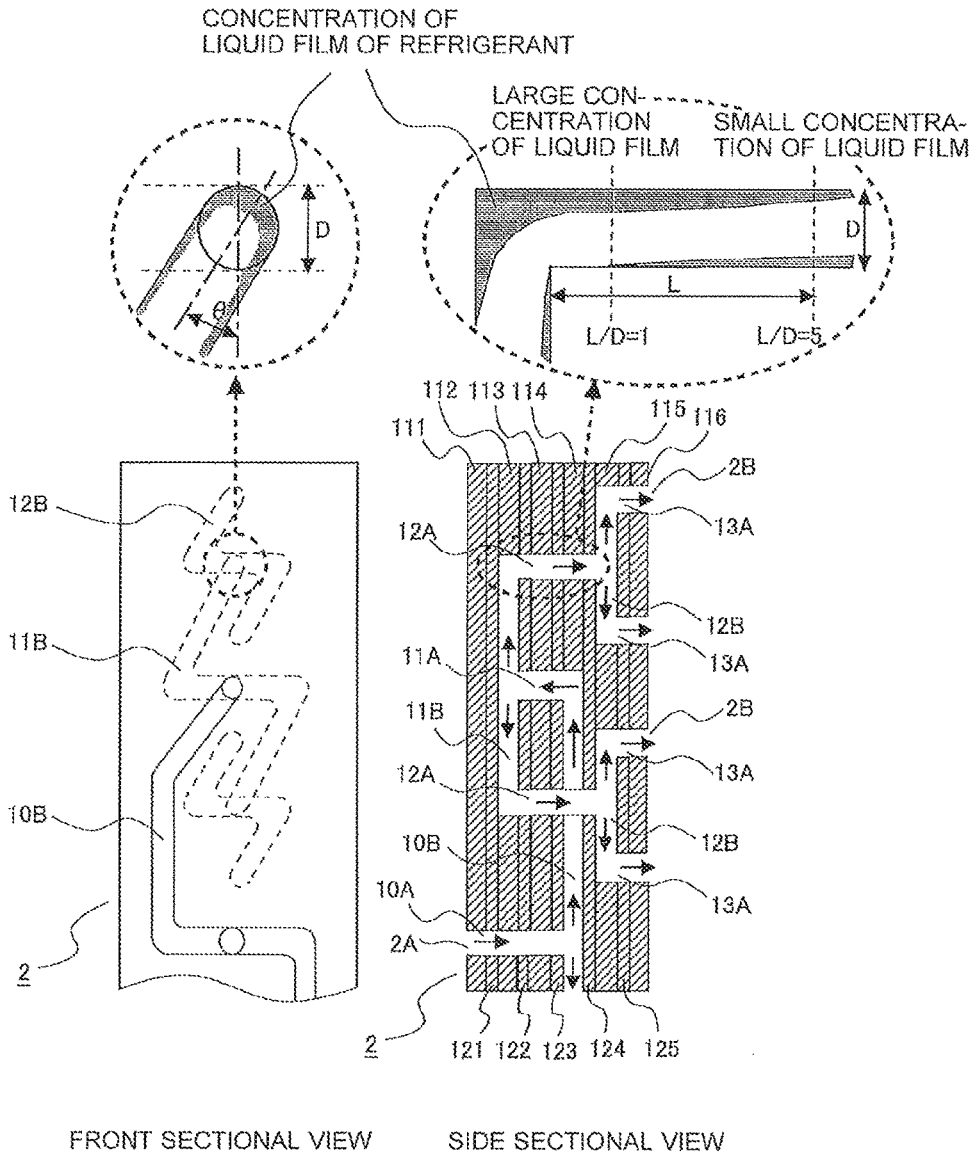
FIG. 3 is a front sectional view and a side sectional view of distribution flow passages of the laminated header according to Embodiment 1.

FIG. 3 is a front sectional view and a side sectional view of the distribution flow passages of the laminated header according to Embodiment 1.

As illustrated in FIG. 3, the distribution flow passages for refrigerant in the laminated header 2 bend at a right angle and branch at a plurality of positions to be connected to the plurality of refrigerant outflow ports 2B. When refrigerant flows through the distribution flow passages, as illustrated in FIG. 3, a liquid film of the refrigerant concentrates in the outward direction of the passages in the bending portions and the branching portions of the passages and tends to travel on the outer peripheral side of such portions due to the centrifugal force. If the refrigerant flows into the next branching flow passages under this state, the liquid refrigerant concentratedly flows into one of the branching flow passages by a large amount. As a result, the two-phase gas-liquid refrigerant cannot be uniformly distributed to the plurality of heat transfer tubes 4.

In view of the above, in the laminated header 2 according to Embodiment 1, straight portions S having certain lengths, which are indicated by the broken lines of FIG. 2, are formed between the bending portions or the branching portions of the passages and portions at which refrigerant flows into the next branching flow passages.

Specifically, certain lengths are ensured for the first passage 10A, the second passages 11A, and the third passages 12A.

Accordingly, through formation of the straight portions S having certain lengths between the bending portions or the branching portions of the passages for refrigerant and the portions at which refrigerant flows into the next branching flow passages, concentration of a liquid film is eliminated in those straight portions S, and the two-phase gas-liquid refrigerant is uniformly distributed to flow into the next branching flow passages.

The index of the length of the straight portion S for rectifying a two-phase gas-liquid flow is a ratio of a value of the length L of the straight portion S to the inner diameter D of the passage, and is represented by L/D (L: length [m] of straight portion S of passage, D: inner diameter [m] of passage, illustrated in FIG. 3). A stronger rectifying effect is obtained as the length L of the straight portion S is increased or the inner diameter D of the passage is reduced.

Now, pressure loss ΔP of a two-phase gas-liquid flow in the straight portion S of the passage is considered.

The pressure loss ΔP of the two-phase gas-liquid flow in the straight portion S of the passage is expressed by the following expression (1).

[Math. 1]

$$\Delta P = f\frac{L}{D}\frac{1}{2}\rho u^2\cdot\phi^2 = f\frac{L}{D}\frac{1}{2}\rho\left(\frac{Gr}{\pi\cdot D/2}\right)^2\cdot\phi^2 = 2f\frac{L}{D^5}\rho\frac{Gr^2}{\pi^2}\cdot\phi^2 \quad (1)$$

f: friction coefficient, ρ: density [kg/m$^3$], u: flow velocity [m/s], Gr: refrigerant circulating amount [kg/h], φ: enhancement factor of two-phase flow, L: length [m] of straight portion S, D: inner diameter [m] of passage From the expression (1), it is found that when the inner diameter D of the passage is reduced in order to obtain the rectifying effect for the two-phase gas-liquid flow, contribution to increase in pressure loss ΔP is significantly increased. Accordingly, the length L of the straight portion S is increased so that the rectifying effect for the two-phase gas-liquid flow may be obtained while suppressing increase in pressure loss ΔP.

In addition, plates of the laminated header 2 of the present invention are joined together in a furnace by brazing in an integral manner. In order to prevent a brazing material from closing the passages, the passages each need to have an inner diameter D of 2 [mm] or more, and hence the inner diameter D of the passages cannot be significantly small. Thus, it is difficult to cause refrigerant flowing through the passages to have a flow condition of homogeneous flow, e.g., annular dispersed flow, with the use of a restriction function, and hence the refrigerant flows through the passages as annular flow, slug flow, or stratified flow. As a result, the straight portions S for rectifying the two-phase gas-liquid flow are needed.

Now, an optimal value of L/D is described with reference to FIG. 4.

Figure 4:
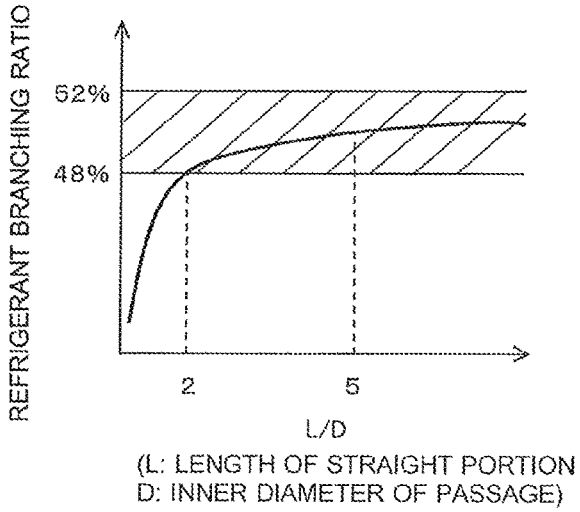
FIG. 4 is a graph for showing a relationship between a distribution ratio of flows of refrigerant to respective heat transfer tubes according to Embodiment 1 and L/D (L: length of straight portion S, D: inner diameter of passage).

FIG. 4 is a graph for showing a relationship between a distribution ratio of flows of refrigerant to the respective heat transfer tubes according to Embodiment 1, and L/D (L: length [m] of straight portion S, D: inner diameter [m] of passage).

As is understood from FIG. 4, as the length L of the straight portion of the passage is increased, a stronger rectifying effect for a liquid film is obtained, but the increase in rectifying effect remains at the same level in a range of 5<L/D. Further, the laminated header 2 is increased in size when L/D is increased.

Further, it is found that the value of L/D is desirably 2 or more in practical terms such that a branching ratio of flows of refrigerant in the branching portion is 48% or more, which is a value that does not deteriorate the performance of the heat exchanger 1.

From the above, through rectification of refrigerant in the straight portion S of the passage with a range of 2≤L/D≤5, the refrigerant branching ratio may be effectively set to an optimal value of from 48% to 52% in the branching portion. As a result, the heat exchange performance of the heat exchanger 1 may be ensured.

In the laminated header 2 according to Embodiment 1, as the straight portion S of the passage, a range of 2≤L1/D1≤5 is ensured where L1 represents the length of the first passage 10A, and D1 represents the inner diameter of the passage. Similarly, as the straight portions S of the passages, a range of 2≤L2/D2≤5 is ensured where L2 represents the length of the second passages 11A, and D2 represents the inner diameter of the passages. In addition, as the straight portions S of the passages, a range of 2≤L3/D3≤5 is ensured where L3 represents the length of the third passages 12A, and D3 represents the inner diameter of the passages. Accordingly, the lengths of the straight portions S of the first passage 10A, the second passages 11A, and the third passages 12A are all set to the range of 2≤L/D≤5. As a result, refrigerant may be uniformly supplied to the heat transfer tubes 4 of the heat exchanger 1, and the heat exchange performance may be ensured.

Further, refrigerant flows through the first passage 10A, the third passages 12A, and the fourth passages 13A in the direction opposite to and reverse to that of refrigerant traveling in the second passages 11A, and hence the laminated header 2 may be reduced in size.

When at least one of the lengths of the straight portions S of the first passage 10A, the second passages 11A, and the third passages 12A is set to the range of 2≤L/D≤5, refrigerant may uniformly branch in each of the branching flow passages downstream of the straight portion S.

Further, the rectifying effect is not reduced even when the value of L/D is 5 or more, and hence the value of L/D may be increased in a range with which the laminated header 2 has allowable dimensions.

Further, when at least the length L2 of the straight portions S of the second passages 11A between the first branching flow passage 10B and the second branching flow passages 11B is set to the range of 2≤L2/D2≤5, the lengths of the first passage 10A and the third passages 12A are longer than that of the second passages 11A. As a result, a necessary and sufficient rectifying effect may be obtained.

In addition, in FIG. 3, an angle θ is defined as an angle formed between a vertical direction (longitudinal direction of first plate-like members 111, 112, 113, 114, 115, and 116 and second plate-like members 121, 122, 123, 124, and 125), and the passage axis of each of both the end portions of the first branching flow passage 10B, the second branching flow passages 11B, and the third branching flow passages 12B, which are substantially Z-shaped through grooves. In this case, the heights in the vertical direction of the first branching flow passage 10B, the second branching flow passages 11B, and the third branching flow passages 12B are reduced in the stated order, and hence the values of the angle θ are increased in the same order. As the angle θ is increased, concentration of a liquid film is increased.

Consequently, particularly when the length L3 of the straight portions S of the third passages, which are formed upstream of the third branching flow passages 12B, is set to the range of 2≤L3/D3≤5, refrigerant may uniformly branch in the third branching flow passages 12B.

<Usage Mode of Heat Exchanger>

Now, an example of a usage mode of the heat exchanger 1 according to Embodiment 1 is described.

In the following, there is described a case where the heat exchanger 1 according to Embodiment 1 is used for an air-conditioning apparatus 20, but the present invention is not limited to such a case, and for example, the heat exchanger according to Embodiment 1 may be used for other refrigeration cycle apparatus including a refrigerant circuit. Further, there is described a case where the air-conditioning apparatus 20 switches between a cooling operation and a heating operation, but the present invention is not limited to such a case, and the air-conditioning apparatus 20 may perform only the cooling operation or the heating operation.

Figure 5:
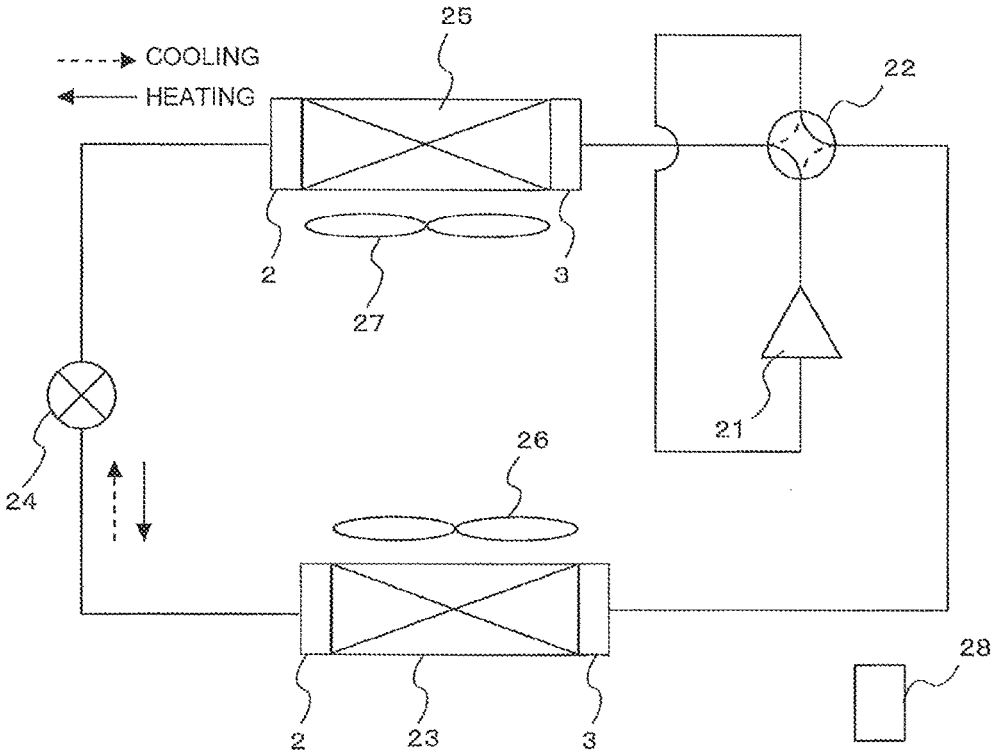
FIG. 5 is a diagram for illustrating a configuration of an air-conditioning apparatus to which the heat exchanger according to Embodiment 1 is applied.

FIG. 5 is a diagram for illustrating the configuration of the air-conditioning apparatus to which the heat exchanger according to Embodiment 1 is applied.

In FIG. 5, the flow of the refrigerant during the cooling operation is indicated by the dotted arrow, while the flow of the refrigerant during the heating operation is indicated by the solid arrow.

As illustrated in FIG. 5, the air-conditioning apparatus 20 includes a compressor 21, a four-way valve 22, an outdoor heat exchanger (heat source-side heat exchanger) 23, an expansion device 24, an indoor heat exchanger (load-side heat exchanger) 25, an outdoor fan (heat source-side fan) 26, an indoor fan (load-side fan) 27, and a controller 28. The compressor 21, the four-way valve 22, the outdoor heat exchanger 23, the expansion device 24, and the indoor heat exchanger 25 are connected by refrigerant pipes to form a refrigerant circuit.

The controller 28 is connected to, for example, the compressor 21, the four-way valve 22, the expansion device 24, the outdoor fan 26, the indoor fan 27, and various sensors. The controller 28 switches the flow passage of the four-way valve 22 to switch between the cooling operation and the heating operation.

The flow of the refrigerant during the cooling operation is described.

The refrigerant in a high-pressure and high-temperature gas state discharged from the compressor 21 passes through the four-way valve 22 to flow into the outdoor heat exchanger 23, and is condensed through heat exchange with air supplied by the outdoor fan 26. The condensed refrigerant is brought into a high-pressure liquid state to flow out of the outdoor heat exchanger 23. The refrigerant is then brought into a low-pressure two-phase gas-liquid state by the expansion device 24. The refrigerant in the low-pressure two-phase gas-liquid state flows into the indoor heat exchanger 25, and is evaporated through heat exchange with air supplied by the indoor fan 27, to thereby cool the inside of a room. The evaporated refrigerant is brought into a low-pressure gas state to flow out of the indoor heat exchanger 25. The refrigerant then passes through the four-way valve 22 to be sucked into the compressor 21.

The flow of the refrigerant during the heating operation is described.

The refrigerant in a high-pressure and high-temperature gas state discharged from the compressor 21 passes through the four-way valve 22 to flow into the indoor heat exchanger 25, and is condensed through heat exchange with air supplied by the indoor fan 27, to thereby heat the inside of the room. The condensed refrigerant is brought into a high-pressure liquid state to flow out from the indoor heat exchanger 25. The refrigerant then turns into refrigerant in a low-pressure two-phase gas-liquid state by the expansion device 24. The refrigerant in the low-pressure two-phase gas-liquid state flows into the outdoor heat exchanger 23, and is evaporated through heat exchange with air supplied by the outdoor fan 26. The evaporated refrigerant is brought into a low-pressure gas state to flow out of the outdoor heat exchanger 23.

The refrigerant then passes through the four-way valve 22 to be sucked into the compressor 21.

The heat exchanger 1 is used for at least one of the outdoor heat exchanger 23 or the indoor heat exchanger 25. When the heat exchanger 1 functions as the evaporator, the heat exchanger 1 is connected so that the refrigerant flows in from the laminated header 2 and the refrigerant flows out toward the cylindrical header 3. That is, when the heat exchanger 1 functions as the evaporator, refrigerant in a two-phase gas-liquid state flows into the laminated header 2 through the refrigerant pipes, and branches to flow into each of the heat transfer tubes 4 of the heat exchanger 1.

Further, when the heat exchanger 1 functions as the condenser, liquid refrigerant flows into the laminated header 2 through each of the heat transfer tubes 4 such that the flows of the refrigerant join together, and then the refrigerant flows out through the refrigerant pipe.

MODIFIED EXAMPLE

In the laminated header 2 according to Embodiment 1, in order to set the lengths L1, L2, and L3 of the straight portions S of the first passage 10A, the second passages 11A, and the third passages 12A to the certain lengths or more, the plurality of plates of the first plate-like member 113 and the second plate-like members 122 and 123 are laminated such that the length L of the straight portion S is ensured. However, Modified Example is an example in which the lengths of the first passage 10A, the second passages 11A, and the third passages 12A are adjusted through adjustment of the thickness of the one second plate-like member 123.

The remaining configuration of the distribution flow passages is similar to that of the laminated header 2 according to Embodiment 1.

Further, the heat exchanger 1 using the laminated header 2 according to Modified Example, a usage mode of the heat exchanger 1, and others are similar to those of the laminated header 2 according to Embodiment 1.

<Configuration of Laminated Header>

Now, the configuration of Modified Example of the laminated header 2 according to Embodiment 1 is described.

Figure 6:
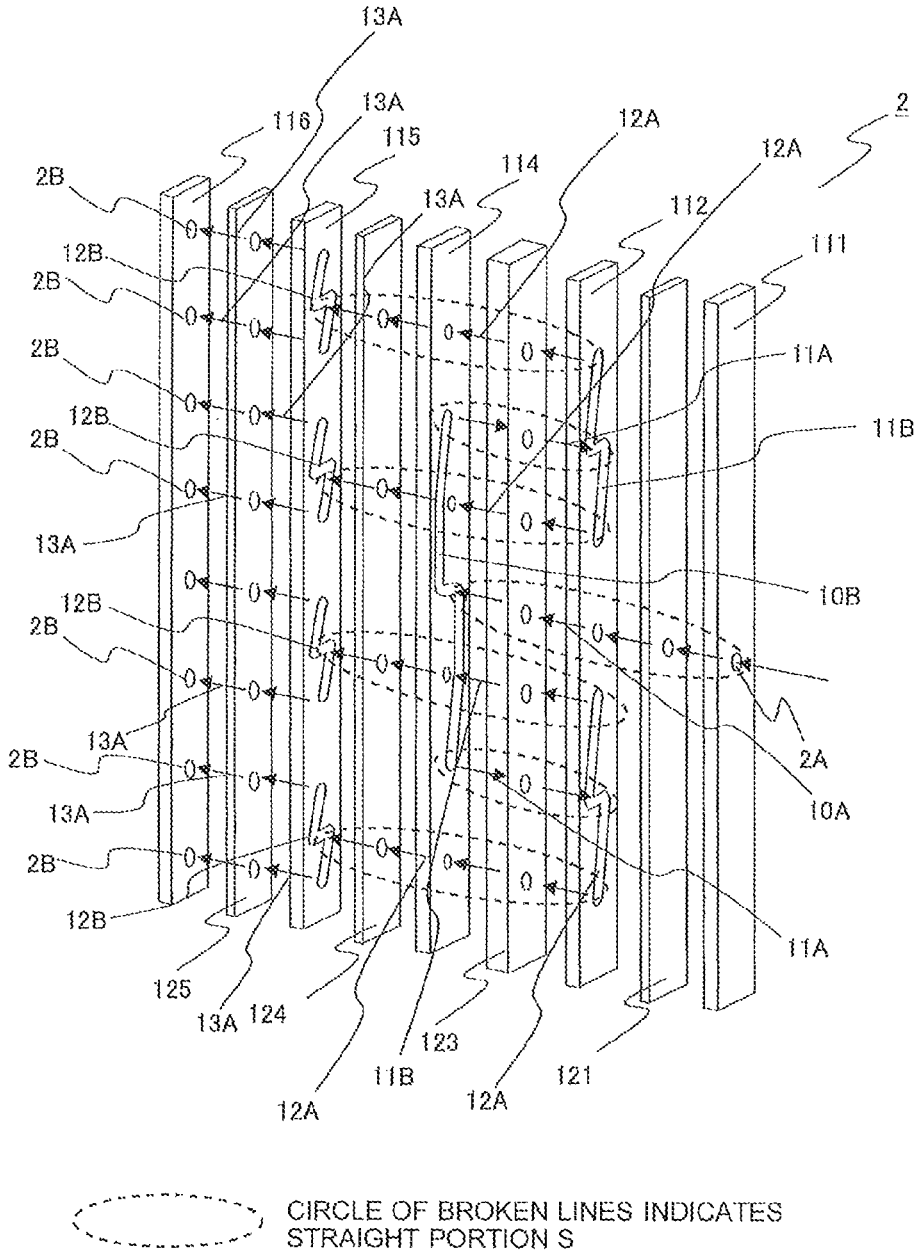
FIG. 6 is an exploded perspective view for illustrating Modified Example of the laminated header according to Embodiment 1.

FIG. 6 is an exploded perspective view for illustrating Modified Example of the laminated header according to Embodiment 1.

The laminated header 2 includes, for example, first plate-like members 111, 112, 114, 115, and 116 and second plate-like members 121, 123, 124, and 125 sandwiched by the first plate-like members.

One or both surfaces of each of the second plate-like members 121, 123, 124, and 125 are applied with a brazing material. The first plate-like members 111, 112, 114, 115, and 116 are laminated via the second plate-like members 121, 123, 124, and 125, and integrally joined together by brazing.

In the laminated header 2, there are formed distribution flow passages configured by a first passage 10A, second passages 11A, third passages 12A, and fourth passages 13A that are circular through holes formed in the first plate-like members 111, 113, 114, 115, and 116 and the second plate-like members 121, 123, 124, and 125, and branching flow passages 10B, 11B, and 12B that are substantially S-shaped or substantially Z-shaped through grooves.

As described above, in the laminated header 2 according to Modified Example illustrated in FIG. 6, the distribution flow passages similar to those of the laminated header 2 according to Embodiment 1 are formed, and through adjustment of the thickness of the one second plate-like member 123, the first passage 10A, which is the straight portion S of the passage indicated by the circle of the broken lines, is set to the range of $2 \leq L1/D1 \leq 5$. Similarly, the second passages 11A are set to the range of $2 \leq L2/D2 \leq 5$. In addition, the third passages 12A are set to the range of $2 \leq L3/D3 \leq 5$.

In this case, only through adjustment of the thickness of the one second plate-like member 123, refrigerant may be uniformly supplied to the heat transfer tubes 4 of the heat exchanger 1, and the heat exchange performance may be ensured. As a result, the laminated header 2 according to Modified Example may be manufactured through simple steps compared to the laminated header 2 according to Embodiment 1. Further, other effects are similar to those of the laminated header 2 according to Embodiment 1.

COMPARATIVE EXAMPLE

In the distribution flow passages of the laminated header 2 according to Embodiment 1, refrigerant flows through the first passage 10A, the third passages 12A, and the fourth passages 13A in the direction opposite to and reverse to that of refrigerant traveling in the second passages 11A.

In contrast, in Comparative Example, refrigerant flows through the first passage 10A, the second passages 11A, the third passages 12A, and the fourth passages 13A in the same direction.

<Configuration of Laminated Header>

Now, the configuration of Comparative Example of the laminated header 2 according to Embodiment 1 is described.

Figure 7:
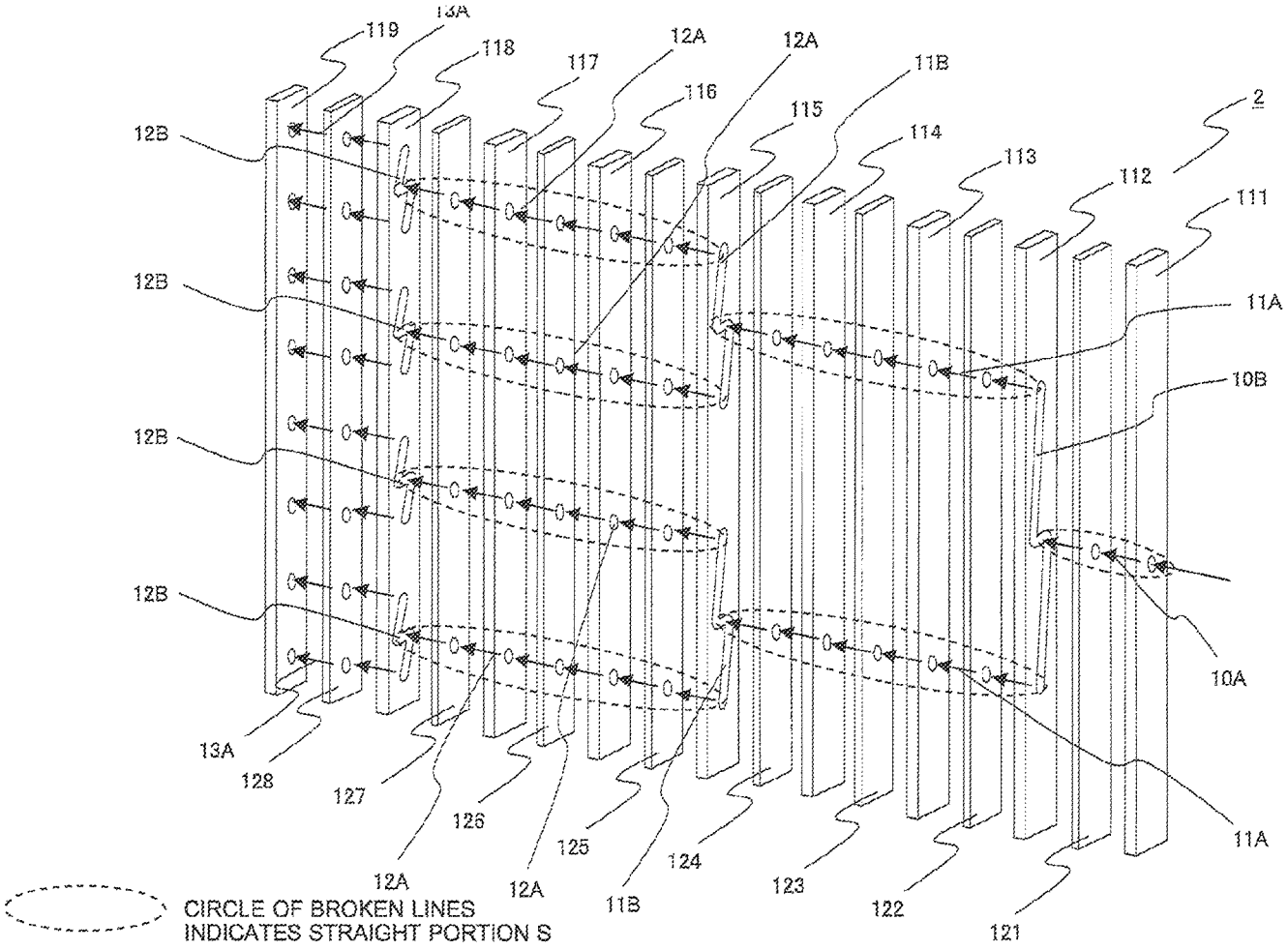
FIG. 7 is an exploded perspective view for illustrating Comparative Example of the laminated header according to Embodiment 1.

FIG. 7 is an exploded perspective view for illustrating Comparative Example of the laminated header according to Embodiment 1.

The laminated header 2 includes, for example, first plate-like members 111, 112, 113, 114, 115, 116, 117, 118, and 119 and second plate-like members 121, 122, 123, 124, 125, 126, 127, and 128 sandwiched by the first plate-like members.

One or both surfaces of each of the second plate-like members 121, 122, 123, 124, 125, 126, 127, and 128 are applied with a brazing material. The first plate-like members 111, 112, 113, 114, 115, 116, 117, 118, and 119 are laminated via the second plate-like members 121, 122, 123, 124, 125, 126, 127, and 128 and integrally joined together by brazing.

In the laminated header 2, there are formed distribution flow passages configured by a first passage 10A, second passages 11A, third passages 12A, and fourth passages 13A that are circular through holes formed in the first plate-like members 111, 112, 113, 114, 115, 116, 117, 118, and 119 and the second plate-like members 121, 122, 123, 124, 125, 126, 127, and 128, and branching flow passages 10B, 11B, and 12B that are substantially S-shaped or substantially Z-shaped through grooves.

In the distribution flow passages of the laminated header 2 according to Comparative Example illustrated in FIG. 7, unlike the laminated header 2 according to Embodiment 1 in which refrigerant flows in the opposite directions, refrigerant flows through the first passage 10A, the second passages 11A, the third passages 12A, and the fourth passages 13A in the same direction.

Here, in Comparative Example, when each of the first passage 10A, the second passages 11A, and the third passages 12A, which are the straight portions S indicated by the circles of the broken lines illustrated in FIG. 7, is set to the range of $2 \leq L/D \leq 5$ (L: length [m] of straight portion S, D: inner diameter [m] of passage), the dimensions on the lamination side of Comparative Example are larger than the dimensions on the lamination side of the laminated header 2 according to Embodiment 1 or Modified Example because the first passage 10A, the second passages 11A, the third passages 12A, and the fourth passages 13A are arranged in a series direction.

In contrast, in the distribution flow passages of the laminated header 2 according to Embodiment 1 or Modified Example of Embodiment 1, refrigerant flows through the first passage 10A, the third passages 12A, and the fourth passages 13A in the direction opposite to and reverse to that of refrigerant flowing through the second passages 11A. As a result, the laminated header 2 according to Embodiment 1 or Modified Example may be reduced in size and smaller than Comparative Example. Further, in a case of the laminated header 2 according to Embodiment 1 or Modified Example of Embodiment 1 having the same dimensions as Comparative Example, the length L of each straight portion S of the first passage 10A, the second passages 11A, and the third passages 12A may be set to a larger value than in Comparative Example. Thus, the rectifying effect for a liquid film may be more enhanced.

REFERENCE SIGNS LIST heat exchanger 2 laminated header 2A refrigerant inflow port (first opening) 2B refrigerant oufflow port (second opening) 3 cylindrical header 3A refrigerant inflow port 3B refrigerant oufflow port 4 heat transfer tube 5 retaining member 6 fin 10A first passage 10B first branching flow passage 11A second passage 11B second branching flow passage 12A third passage 12B third branching flow passage 13A fourth passage 20 air-conditioning apparatus 21 compressor 22 four-way valve 23 outdoor heat exchanger 24 expansion device 25 indoor heat exchanger 26 outdoor fan

27 indoor fan 28 controller 111, 112, 113, 114, 115, 116, 117, 118, 119 first plate-like member 121, 122, 123, 124, 125, 126, 127, 128 second plate-like member

The invention claimed is:

1. A laminated header, comprising:

a plurality of plate-like members, each of the plurality of plate-like members being laminated with each other;

one first opening;

a plurality of second openings; and a distribution flow passage connecting the one first opening and each of the plurality of second openings to each other, the distribution flow passage comprising:

a first passage;

a first branching flow passage for the first passage to branch into a plurality of passages;

a second passage connected to each of the plurality of passages branched in the first branching flow passage;

a second branching flow passage for the second passage to branch into a plurality of passages; and a third passage connected to each of the plurality of passages branched in the second branching flow passage, refrigerant flowing into the distribution flow passage flowing through the first passage and the second passage in directions opposite to and reverse to each other, and flowing through the second passage and the third passage in directions opposite to and reverse to each other.

2. The laminated header of claim 1, wherein the first branching flow passage is formed in one first branching plate-like member, wherein the second branching flow passage is formed in one second branching plate-like member, and wherein the distribution flow passage is formed between the first branching plate-like member and the second branching plate-like member by laminating two or more of the plurality of plate-like members.

3. The laminated header of claim 1, wherein the first branching flow passage is formed in one first branching plate-like member, wherein the second branching flow passage is formed in one second branching plate-like member, and wherein the distribution flow passage is formed between the first branching plate-like member and the second branching plate-like member by arranging one of the plurality of the plate-like members.

4. The laminated header of claim 1, wherein the second passage is formed to have a circular sectional shape with an inner diameter dimension D2, and a straight line shape with a length dimension L2 in an axial direction of the second passage, and wherein a value of D2/L2 is set to a range of $2 \leq D2/L2 \leq 5$.

5. The laminated header of claim 1, wherein the third passage is formed to have a circular sectional shape with an inner diameter dimension D3, and a straight line shape with a length dimension L3 in an axial direction of the third passage, and wherein a value of D3/L3 is set to a range of $2 \leq D3/L3 \leq 5$.

6. The laminated header of claim 1, wherein the first passage is formed to have a circular sectional shape with an inner diameter dimension D1, and a straight line shape with a length dimension L1 in an axial direction of the first passage, wherein the second passage is formed to have a circular sectional shape with an inner diameter dimension D2, and a straight line shape with a length dimension L2 in an axial direction of the second passage, wherein the third passage is formed to have a circular sectional shape with an inner diameter dimension D3, and a straight line shape with a length dimension L3 in an axial direction of the third passage, and wherein a value of D1/L1, a value of D2/L2, and a value of D3/L3 are set to a range of 2 or more and 5 or less.

7. The laminated header of claim 1, wherein the first passage is formed to have a circular sectional shape with an inner diameter dimension D1, and a straight line shape with a length dimension L1 in an axial direction of the first passage, wherein the second passage is formed to have a circular sectional shape with an inner diameter dimension D2, and a straight line shape with a length dimension L2 in an axial direction of the second passage, wherein the third passage is formed to have a circular sectional shape with an inner diameter dimension D3, and a straight line shape with a length dimension L3 in an axial direction of the third passage, and wherein at least one of a value of D1/L1, a value of D2/L2, and a value of D3/L3 is set to a range of 2 or more and 5 or less.

8. A heat exchanger, comprising:

the laminated header of claim 1; and a plurality of heat transfer tubes connected to the plurality of second openings, respectively.

9. An air-conditioning apparatus, comprising the heat exchanger of claim 8.

* * * * *